US008079426B2

(12) United States Patent
Petersson

(10) Patent No.: US 8,079,426 B2
(45) Date of Patent: Dec. 20, 2011

(54) INTEGRATED DRILLING DECK AND BOP HANDLING

(75) Inventor: Inge Petersson, Torslanda (SE)

(73) Assignee: GVA Consultants AB, Gothenburg (SE)

( * ) Notice: Subject to any disclaimer, the term of this patent is extended or adjusted under 35 U.S.C. 154(b) by 0 days.

(21) Appl. No.: 12/426,337

(22) Filed: Apr. 20, 2009

(65) Prior Publication Data

US 2009/0223660 A1 Sep. 10, 2009

Related U.S. Application Data

(63) Continuation of application No. PCT/SE2007/000904, filed on Oct. 16, 2007.

(30) Foreign Application Priority Data

Oct. 19, 2006 (SE) ..... 0602201

(51) Int. Cl.
*E21B 7/12* (2006.01)
*E21B 15/02* (2006.01)

(52) U.S. Cl. ..... 175/5; 166/352; 166/358; 166/85.4; 114/264

(58) Field of Classification Search ..... 175/5–10; 166/351–355, 358, 367, 85.1, 85.4; 114/264–266
See application file for complete search history.

(56) References Cited

U.S. PATENT DOCUMENTS 3,256,936 A * 6/1966 Johnson et al. ..... 166/354
3,498,392 A * 3/1970 Knorr ..... 175/5
3,718,266 A * 2/1973 Donnally ..... 414/22.71
3,895,677 A * 7/1975 Bokenkamp ..... 166/359
3,981,369 A * 9/1976 Bokenkamp ..... 175/5
4,007,782 A * 2/1977 Nybo et al. ..... 166/79.1
4,063,650 A * 12/1977 Homer ..... 105/29.1
4,081,163 A * 3/1978 Guinn et al. ..... 248/637
4,108,318 A * 8/1978 Rode et al. ..... 414/22.51
4,199,847 A * 4/1980 Owens ..... 188/67
4,230,190 A * 10/1980 Guinn et al. ..... 175/5
4,367,796 A * 1/1983 Bolding ..... 166/341
4,574,241 A * 3/1986 Stelly ..... 324/326
4,626,135 A * 12/1986 Roche ..... 405/224.2
4,899,682 A * 2/1990 Pouget et al. ..... 114/264
5,647,443 A * 7/1997 Broeder ..... 175/5
5,704,427 A * 1/1998 Buck et al. ..... 166/338
6,047,781 A * 4/2000 Scott et al. ..... 175/5
6,056,071 A * 5/2000 Scott et al. ..... 175/5
6,068,069 A * 5/2000 Scott et al. ..... 175/5
6,085,851 A * 7/2000 Scott et al. ..... 175/7
6,217,258 B1 * 4/2001 Yamamoto et al. ..... 405/201
6,321,675 B1 * 11/2001 Dybdahl et al. ..... 114/264
6,554,072 B1 * 4/2003 Mournian et al. ..... 166/355
6,766,860 B2 * 7/2004 Archibald et al. ..... 166/341
6,926,488 B1 * 8/2005 Bolding et al. ..... 414/22.62
6,955,223 B2 * 10/2005 Orr et al. ..... 166/378

(Continued)

*Primary Examiner* — Thomas Beach
*Assistant Examiner* — Matthew Buck
(74) *Attorney, Agent, or Firm* — Gesmer Updegrove LLP

(57) ABSTRACT

A method for handling a blow-out-preventer on a drilling platform and a drilling platform having a lower pontoon structure; a plurality of columns extending upwards from the lower pontoon structure; an upper deck structure connecting the upper deck structure connecting the upper portions of the columns to each other; a detachable rotary table assembly arranged in a rotary table opening in the upper deck structure; a derrick provided with a lifting arrangement and being arranged on the upper deck structure above the rotary table opening; and a detachable rotary table assembly a spider and a blow-out-preventer.

8 Claims, 12 Drawing Sheets

U.S. PATENT DOCUMENTS 7,021,402 B2 * 4/2006 Beato et al. ..... 175/7
7,219,739 B2 * 5/2007 Robichaux ..... 166/355
7,314,087 B2 * 1/2008 Robichaux ..... 166/355
7,628,225 B2 * 12/2009 Petersson et al. ..... 175/5
7,658,228 B2 * 2/2010 Moksvold ..... 166/345
7,699,109 B2 * 4/2010 May et al. ..... 166/367
2007/0251725 A1 * 11/2007 Banks ..... 175/5
2007/0284113 A1 * 12/2007 Haheim ..... 166/345

* cited by examiner

INTEGRATED DRILLING DECK AND BOP HANDLING

PRIORITY INFORMATION

The present application is a continuation of PCT Application No. PCT/SE2007/000904 filed on Oct. 16, 2007, and claims priority to Swedish Application No. SE 0602201-6, filed on Oct. 19, 2006. Both applications are incorporated herein by reference in their entireties.

TECHNICAL FIELD

The present invention relates to a floating offshore drilling platform with a drilling deck integrated in the main deck. More particularly, the invention relates to a floating offshore drilling platform with a drilling deck integrated in the main deck and with an improved handling of the blow-out-preventer.

BACKGROUND OF THE INVENTION

It is well known to those skilled in the art that offshore drilling platforms are provided with a main deck for supporting such functions and items as cranes, crew quarters, helipad, lifeboats, racks for horizontally storing drill pipes and riser pipes etc. Arranged above the main deck there is typically a drilling deck which supports a derrick. An example of a drilling platform with a drilling deck arranged above a main deck is shown in the patent application WO 00/49266 published on Aug. 24, 2000; see e.g. FIG. 1A and page 5 line 29 and forward.

An offshore drilling platform 100 with a drilling deck 140 arranged above a main 130 deck is also schematically illustrated by FIG. 1 herein. The side view of the offshore drilling platform 100 in FIG. 1 shows a pontoon 110*a* of a lower pontoon structure and two columns 120*a*, 120*b* that extend vertically upwards from the pontoon 110*a* to a main deck structure 130. The main deck 130 connects the upper portions of the columns 120*a*-120*b* to each other so as to form a globally strong and resilient platform design. The drilling deck 140 arranged above the main deck 130 is provided with a rotary table assembly 142 and a derrick 150. The main deck 130 is provided with an opening 132 (sometimes called a moon pool opening) that is vertically aligned with the rotary table assembly 142. In addition, a blow-out-preventer 156 (BOP) is stored on the main deck 130. As can be seen in FIG. 1, the vertical clearance between the main deck 130 and the drilling deck 140 is preferably large enough to accommodate a fully assembled BOP, which is skidded or otherwise moved to a position above the opening 132 in the main deck 130 before it is lowered to the sea bed through the opening 132. It should be observed that the BOP is typically 10-15 meters high with a weight of about 150-350 tons.

Designs as the one shown in FIG. 1 have several drawbacks, A first drawback is that the different levels between the drilling deck 140 and the main deck 130 involves an undesired lifting and climbing activity between the decks 130, 140 having a negative effect on the safety and the productivity. In addition, the design in FIG. 1 results in an undesired high centre of gravity for the drilling platform 100, which is particularly undesired in connection with floating offshore drilling platforms.

In this connection it should be mentioned that it is well known to those skilled in the art that offshore drilling platforms may be provided with an additional cellar floor arranged below the drilling deck. Such a cellar floor may e.g. be an additional floor arranged between the drilling deck and the main deck. An example of a cellar floor can be found in patent U.S. Pat. No. 3,981,369 (Bokenkamp). The drilling deck and the cellar floor are at different levels, which typically results in undesired lifting and climbing, or additional means for lifting and transportation to avoid manual lifting and climbing. Moreover, the vertical clearance between the drilling deck and the cellar floor is typically large enough to accommodate a fully assembled BOP, which results in a rather high design for the drilling platform giving it an undesired high centre of gravity.

Hence, there is a need for a design that provides a compact offshore drilling platform with a low centre of gravity and an improved working environment.

SUMMARY OF THE INVENTION

The present invention is directed to solving the problem of providing a design that enables a compact offshore drilling platform with a low centre of gravity and an improved working environment.

This has been accomplished by a first aspect of the present invention in which a drilling platform comprises a lower pontoon structure, a plurality of columns extending upwards from the lower pontoon structure, an upper deck structure connecting the upper portions of the columns to each other, a derrick, a detachable rotary table assembly a spider and a blow-out-preventer. The drilling platform is characterized in that the upper deck structure is provided with a rotary table opening, which is adapted to receive the detachable rotary table assembly and to allow the blow-out-preventer to pass through, and in that the derrick is arranged on the upper deck structure above the rotary table opening.

Furthermore, a lower deck structure is arranged below the upper deck structure at a vertical distance that is less than the height of the blowout-preventer.

A second aspect of the present invention is directed towards a drilling platform including the features of the first aspect, wherein the upper deck structure is provided with at storage space for the blow-out-preventer.

A third aspect of the present invention is directed towards a drilling platform including the features of the first aspect wherein the upper deck structure is provided with transportation means for transporting the blow-out-preventer on the upper deck structure.

A fourth aspect of the present invention is directed towards a drilling platform including the features of the fourth aspect wherein process tanks and mud pits are arranged on the lower deck structure and being interconnected by means of a pump arrangement for pumping drilling mud from the process tanks to the mud pits.

A solution to the above mentioned problem has also been accomplished by a fifth aspect of the present invention comprising a method for handling a blow-out-preventer on a drilling platform having a lower pontoon structure, a plurality of columns extending upwards from the lower pontoon structure, an upper deck structure connecting the upper portions of the columns to each other, a detachable rotary table assembly arranged in a rotary table opening in the upper deck structure, a derrick provided with a lifting arrangement and being arranged on the upper deck structure above the rotary table opening, and a detachable rotary table assembly, a spider and a blow-out-preventer.

The method is characterized by the steps of:

detaching the rotary table assembly from the rotary table opening, arranging at least the spider on the blow-out-preventer, positioning the blow-out-preventer so that the lifting arrangement of the derrick can lower the blow-out-preventer through the rotary table opening, lowering the spider and the blow-out-preventer into the rotary table opening by means of said lifting arrangement, so that the blow-out-preventer is passed through the rotary table opening and so that the spider is arranged in the rotary table opening in an operative position for supporting riser pipes.

A sixth aspect of the present invention is directed to a method including the features of the sixth aspect and the extended steps of:

arranging both the rotary table assembly and the spider on the blow-out-preventer, lowering both the rotary table assembly and the spider as well as the blow-out-preventer into the rotary table opening by means of the lifting arrangement of the derrick, so that the blow-out preventer is passed through the rotary table opening, and so that the rotary table assembly is arranged in the rotary table opening in an operative position for supporting the drilling pipes, and so that the spider is arranged in an operative position for supporting riser pipes.

A seventh aspect of the present invention is directed to a method including the features of the sixth aspect, wherein the spider is replaced by the rotary table assembly by the steps of:

supporting the riser pipes by a riser pipe tensioner arrangement, removing and transporting the spider from the rotary table opening by the lifting arrangement of the derrick and transportation means on the upper deck structure, transporting and lowering the rotary table assembly to an operative position in the rotary table opening by transportation means and the lifting arrangement of the derrick.

An eigth aspect of the present invention is directed to a method including the features of the seventh aspect, wherein the spider is removed by the steps of:

supporting the riser pipes by a riser pipe tensioner arrangement.

removing and transporting the spider from the rotary table opening by the lifting arrangement of the derrick and transportation means on the upper deck structure.

It should be emphasised that the steps preformed by the invention, which are at least partly mentioned above, must not necessarily be performed in the order in which they are listed in this description or in the appended claims.

It should also be emphasized that the term "comprises/comprising" when used in this specification is taken to specify the presence of stated features, integers, steps or components, but does not preclude the presence or addition of one or more other features, integers, steps, components or groups thereof.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF PREFERRED EMBODIMENTS OF THE INVENTION

Figure 2A:
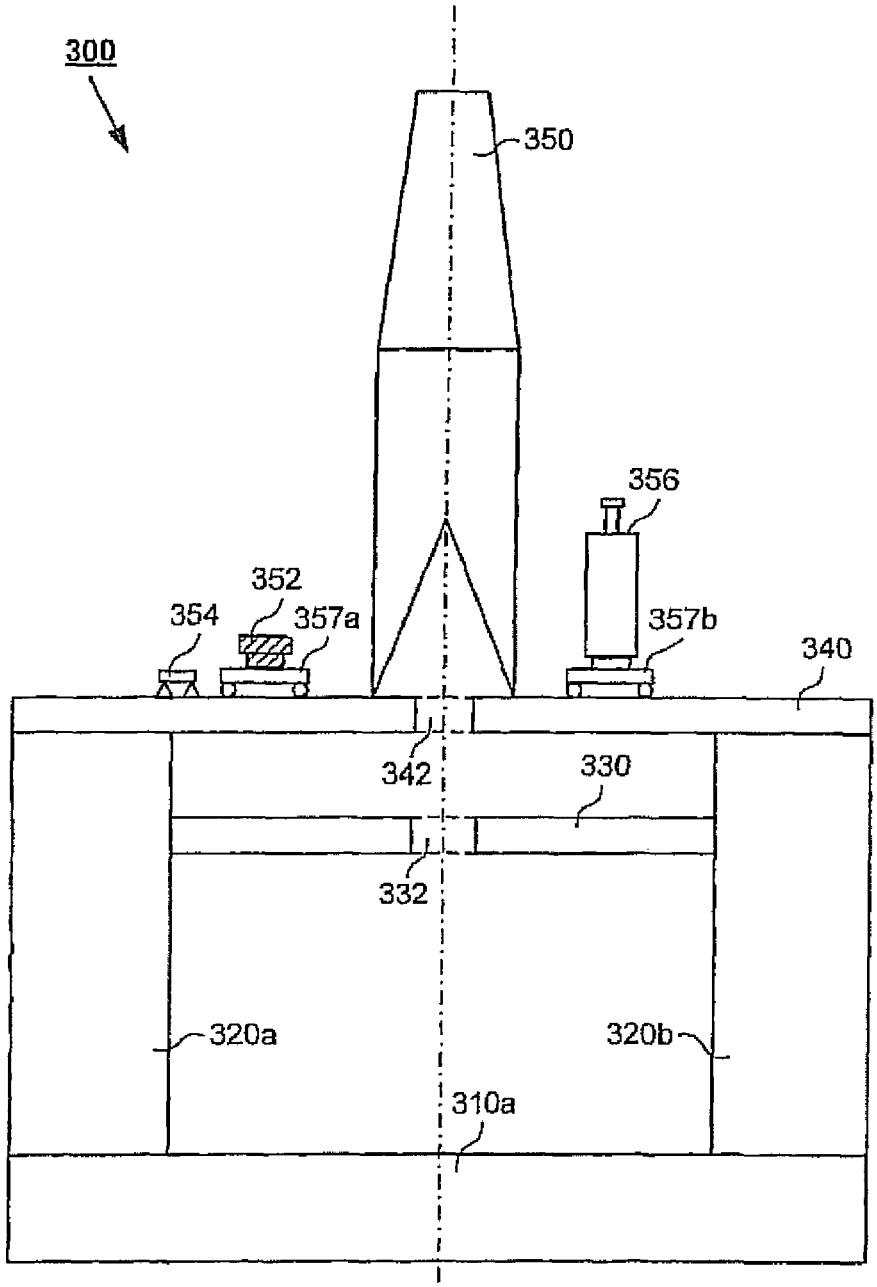
FIG. 2*a* is a schematic illustration of a side view of an offshore drilling platform 300 according to an embodiment of the present invention.
Figure 2B:
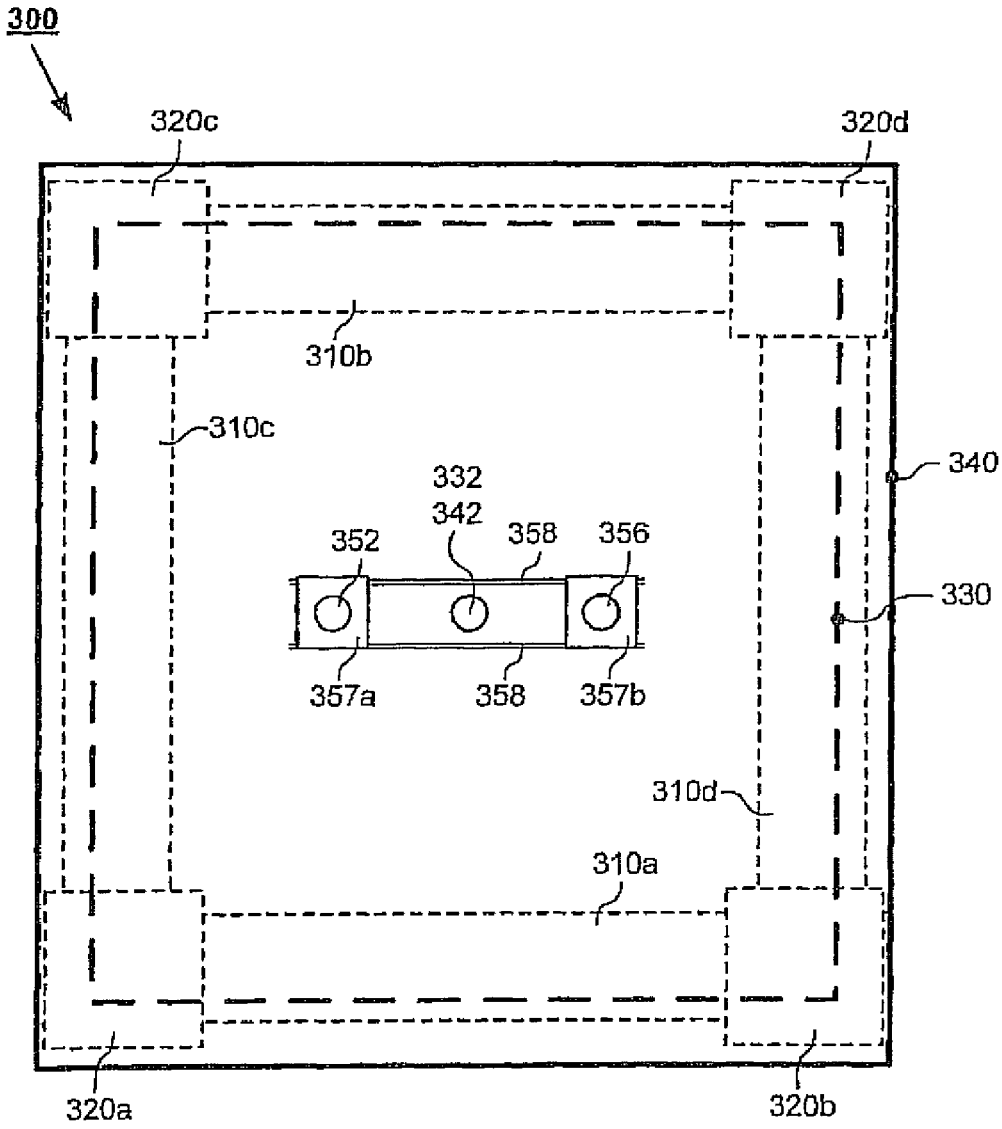
FIG. 2*b* is a schematic illustration of the top view of the offshore drilling platform in FIG. 2*a*.
Figure 2C:
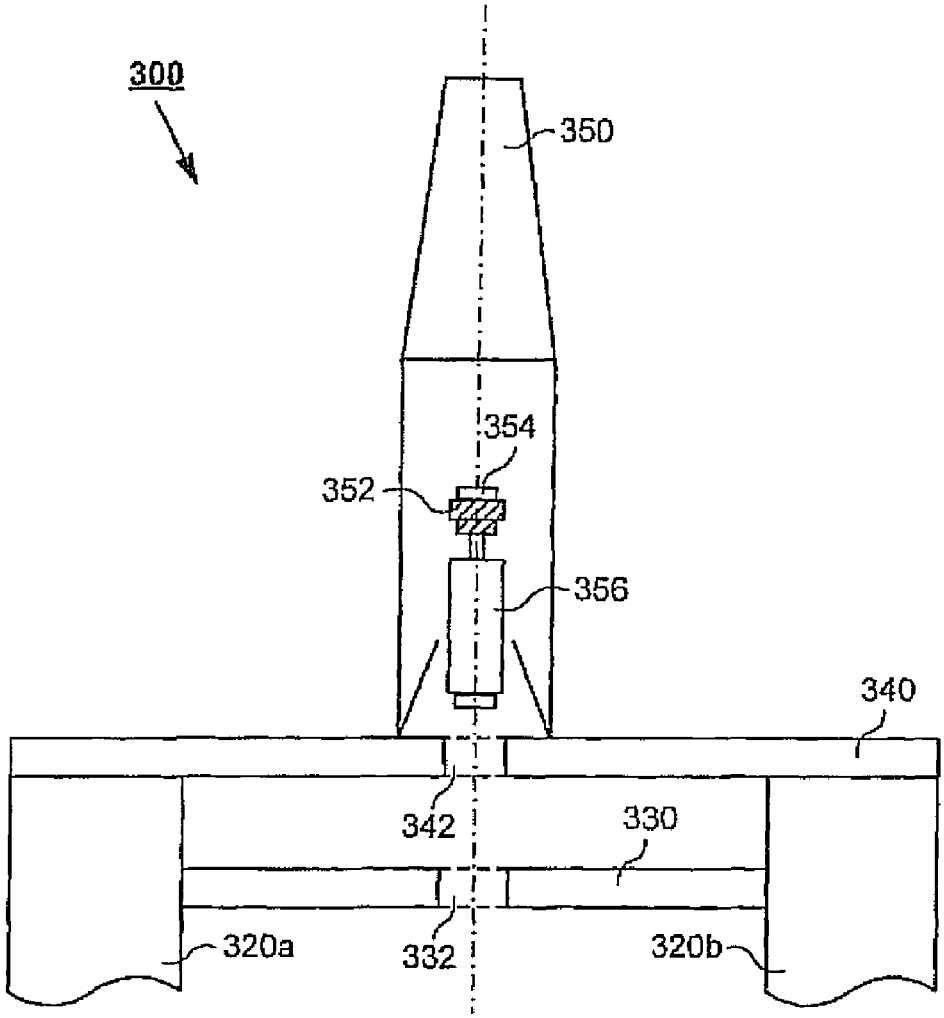
FIG. 2*c* shows the drilling platform 300 in FIG. 2*a* with the spider 354 arranged on top of the rotary table assembly 352 being further arranged on top of the BOP 356, which is positioned to be lowered by the lifting arrangement of the derrick 350.
Figure 2D:
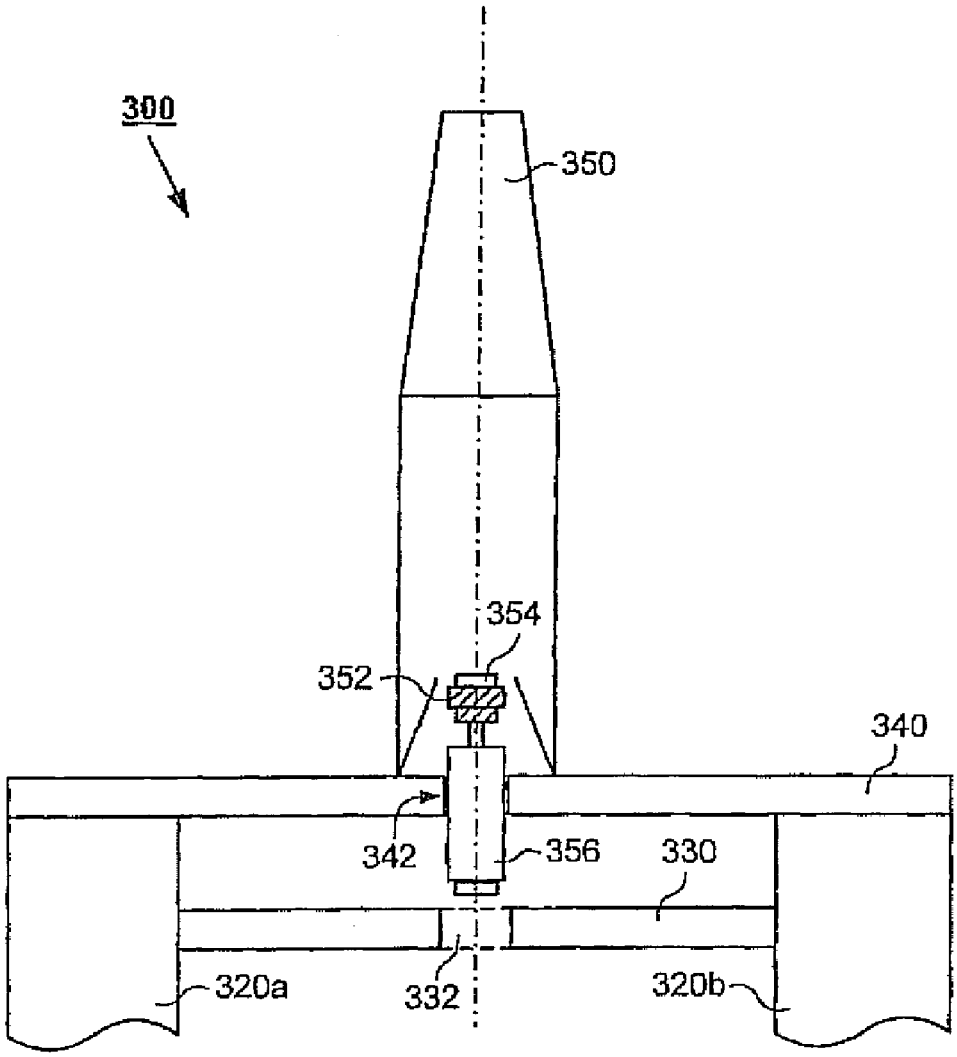
FIG. 2*d* shows a schematic illustration of an early phase in the lowering of the assembled spider 354, rotary table assembly 352 and BOP 356.

FIG. 2*a* is a schematic side view of an offshore drilling platform 300 according to an embodiment of the present invention, whereas FIG. 2*b* is a schematic illustration of the top view of the drilling platform in FIG. 2*a*. It is preferred that the drilling platform in FIG. 2*a*-2*b* is a semi-submersible offshore drilling platform 300.

The drilling platform 300 is schematically illustrated without any unnecessary details. As can be seen in FIG. 2*a*-2*b* the platform 300 comprises a substantially rectangular, ring-shaped lower pontoon structure 310*a*-310*d*. The term "substantially ring-shaped" is used as a label for a closed pontoon structure, which encloses a central opening. Such a pontoon structure is often popularly referred to simply as a "ring-pontoon". Thus, the pontoon structure 310*a*-310*d* schematically illustrated in FIG. 2*a*-2*b* is generally rectangular, whereas alternative embodiments may include other general pontoon shapes, such as polyhedral or circular pontoons 2 (not shown). Other pontoon configurations are clearly conceivable for the submerged structure of the drilling rig, e.g. such as the "two parallel" structure.

The embodiment shown in FIG. 2*a*-2*b* has four columns 320*a*, 320*b*, 320*c* and 320*d* extending vertically upwards from the lower pontoon structure 310*a*-310*d*. An upper main deck structure 340 connects upper portions of the columns 320*a*-320*d* with each other so as to form a globally strong and resilient platform design.

In addition, it is preferred that a lower deck structure 330 is arranged below the main deck 340 for supporting drilling and/or process equipment, e.g. process tanks and mud pits etc as will be described in more detail later. The lower deck structure 330 may be connected to the upper main deck 340 and/or to the columns 320*a*-320*d*.

Preferably, the main deck structure 340 and the lower deck structure 330 are at least partly made of beam constructions and the decks are at least partly provided with suitable working surfaces so that the required drilling activities can be conveniently performed by the platform crew. In particular, it is preferred that the main deck 340 is provided with a substantially flat working surface.

The main deck 340 is provided with a rotary table opening 342 adapted to receive a detachable rotary table 352 and a diverter housing 352', jointly denoted as "rotary table assembly 352" if not otherwise explicitly stated below. In addition, the rotary table opening 342 is adapted to allow a blow-out-preventer (BOP) to pass through, as will be explained more thoroughly below. The lower deck structure 330 is similarly provided with an opening 332 (sometimes called a moon pool opening) being vertically aligned with the rotary table opening 342. The two openings 332, 342 are schematically illustrated in FIG. 2*b* as being circular. However, it should be understood that they may be of any suitable shape, e.g. oval, triangular, quadratic or rectangular, or any other suitable shape.

The main deck 340 is also provided with a derrick 350. The derrick 350 is arranged above the rotary table opening 342 and it is preferably provided with a lifting arrangement (not shown). The lifting arrangement may e.g. be a hook attached to a travelling block, as is well known to those skilled in the art. A derrick with a lifting arrangement in the form of a travelling block with a hook is e.g. shown in the above mentioned patent U.S. Pat. No. 3,981,369 (Bokenkamp). It should be added that the lifting arrangement is arranged so as to raise and lower items substantially along or at least substantially in parallel to a centre axis extending through the centre of the rotary table opening 342 and the centre of the opening 332 in the lower deck structure 330, in case a lower deck 330 structure is present. For the sake of convenience, the lifting arrangement of the derrick 350 will hereinafter be referred to as the "derrick hook". However, this should not be interpreted so as to exclude other suitable lifting arrangements.

In addition, a blow-out-preventer (BOP) 356, a rotary table assembly 352 and a spider 354 are stored on the main deck 340. In other words, the upper deck structure (340) is preferably provided with a storage space for at least one of and most preferably for each of the rotary table assembly 352, the spider 354 and the BOP 356. The BOP 356 is a large assembly of valves that is intended to be arranged at the top of the oil well and which is closed by the drilling crew to control the well when unexpected high pressure is present. The rotary table assembly 352 is utilized to support the drill pipe during drilling operations, whereas the spider 354 is utilized to temporarily support the string of riser pipes when riser pipes are connected or disconnected during lowering or raising the string of riser pipes. The function of the rotary table assembly 352 and the spider 354 are well known facts to those skilled in the art, see e.g. the patent U.S. Pat. No. 4,199,847 (Owens).

It is preferred that the BOP 356 and the rotary table assembly 352 (possibly also the spider 354) are arranged on trolleys 357*b*, 357*a* or on sledges or some other suitable transportation means. This enables the SOP 356 and the rotary table assembly 352 (possibly also the spider 354) to be horizontally transported—e.g. along tracks 358 or similar as shown in FIG. 2*b*—to a position below the derrick 350, which enables the derrick 350 to lift the rotary table assembly 352 and the SOP 356 by means of the derrick hook. As can be seen in FIG. 2*a*-2*b*, the BOP 356 and the rotary table assembly 352 may be stored on separate sides of the opening 342. However, other positions are clearly conceivable.

Figure 1:
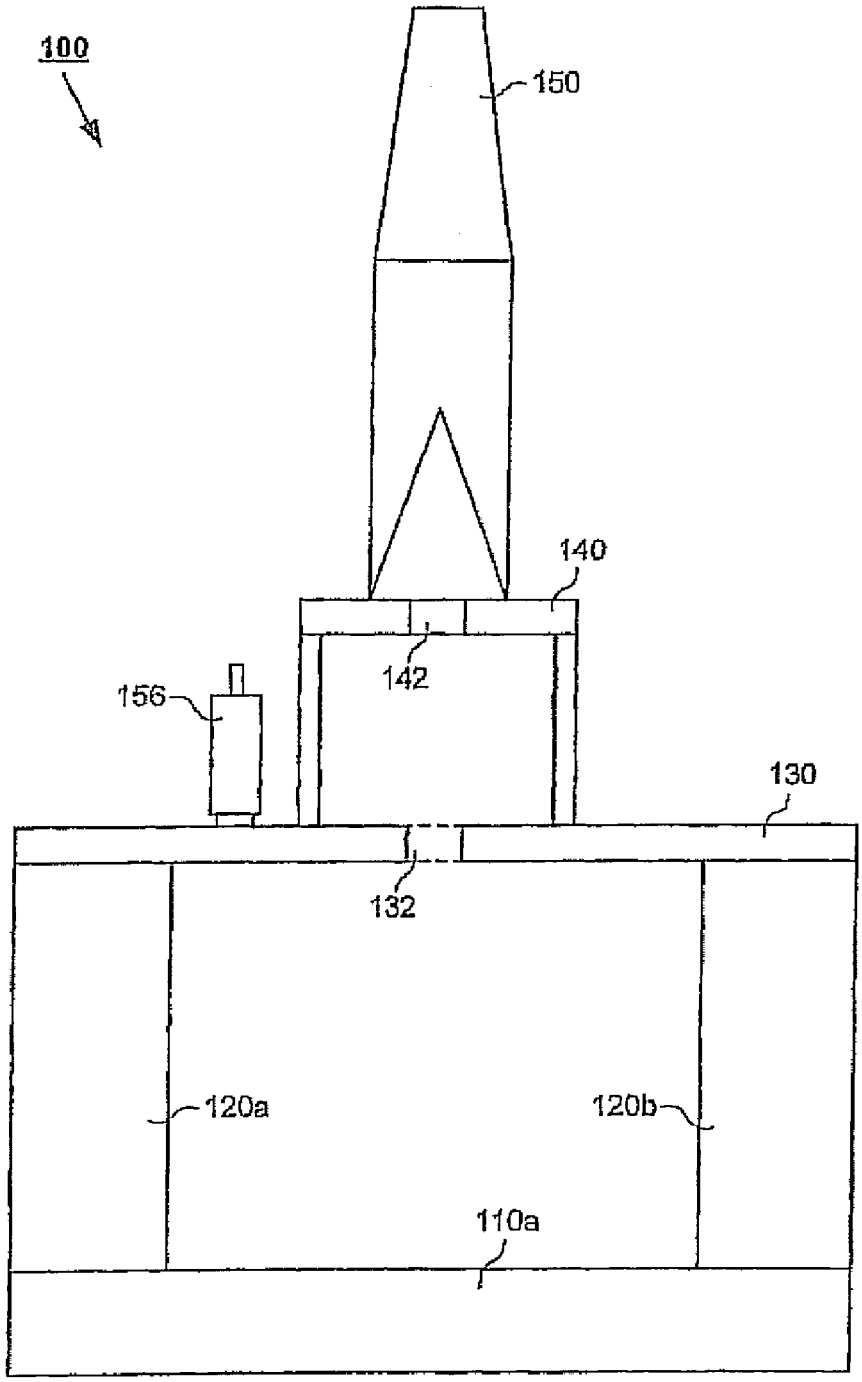
Fig. 1 PRIOR ART
FIG. 1 is a schematic illustration of a side view of an exemplifying offshore drilling platform 100 having a drilling floor 140 arranged above the main deck 130.
Figure 3A:
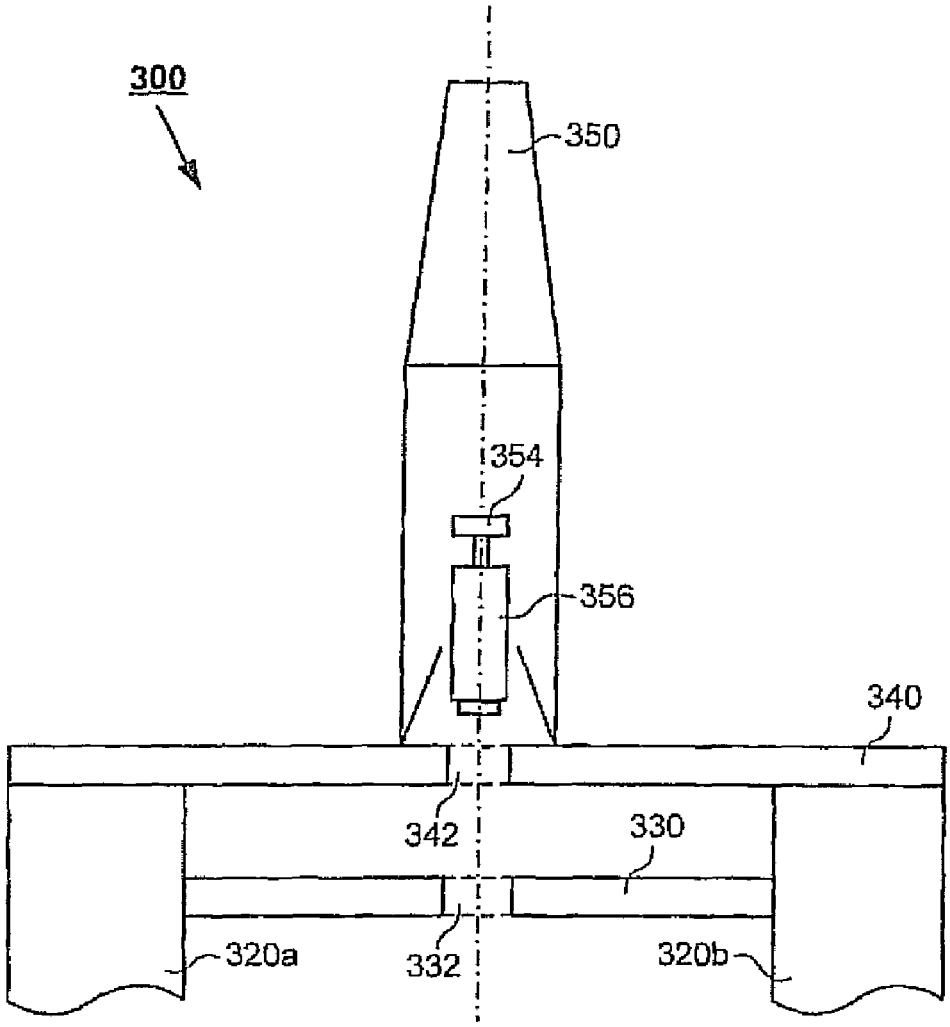
FIG. 3*a* shows the drilling platform 300 in FIG. 2*a* with the spider 354 arranged on top of the BOP 356, which is positioned to be lowered by the lifting arrangement of the derrick 350.
Figure 3B:
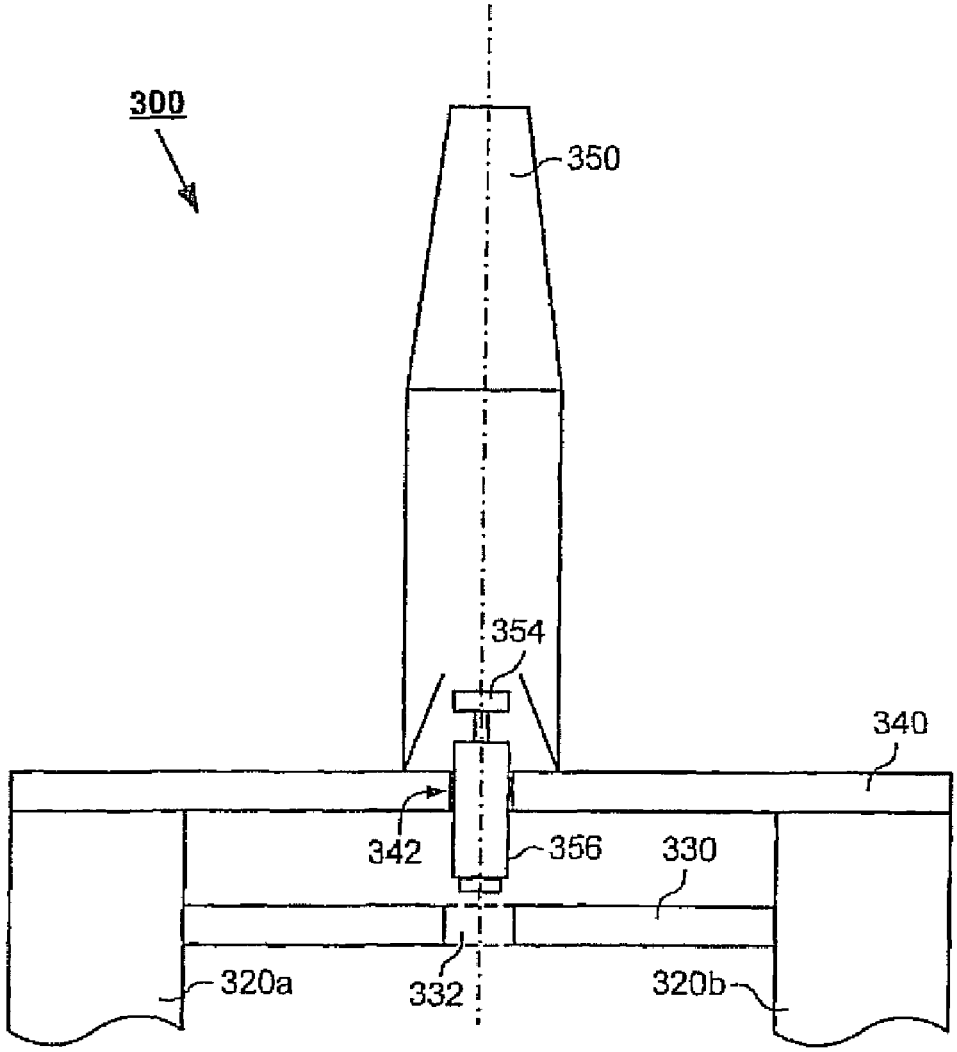
FIG. 3*b* shows a schematic illustration of an early phase in the lowering of the assembled spider 354 and BOP 356.

From the above description of the offshore drilling platform 300 in FIG. 3*a*-3*b* it is clear that the derrick 350 and the BOP 356 are arranged and stored on the same deck, i.e. on the main deck 340. This is in contrast to e.g. U.S. Pat. No. 3,981,369 (Bokenkamp) showing a derrick 15 that is arranged on an upper drilling deck 11 and a BOP 33 that is stored on a cellar deck 14 below the drilling deck 11, see e.g. FIG. 1 in Bokenkamp.

Hence, from the embodiment of the present invention shown in FIG. 2*a*-2*b* it should be clear that the drilling platform 300 has no derrick on a drilling deck arranged above the main deck 340. On the contrary, the derrick 350 is arranged on the main deck 340 of the platform 300 and there is no drilling deck above the main deck 340. These two features, taken alone and particularly taken together provide the drilling platform 300 with a lower centre of gravity compared to e.g. Bokenkamp.

In addition, in cases when there is a need for a lower deck structure 330, storing of the BOP 356 on the main deck 340 as opposed to the lower deck 330 makes it possible to decrease the vertical distance between the lower deck 330 and the main deck 340. In particular, the distance between lower deck 330 and the main deck 340 can be decrease so as to be less than the height of the BOP 356, e.g. less than 12 meters and preferably less than 10 meters and more preferably less than 8 meters and in some cases less than 7 meters and even less than 5 meters. Again, this is in contrast to e.g. U.S. Pat. No. 3,981,369 (Bokenkamp), wherein a BOP 33 is stored on a cellar deck 14 below the drilling deck 11, which requires that the vertical distance between the cellar deck 14 and the drilling deck 11 exceeds the height of the BOP, see e.g. FIG. 1 in Bokenkamp. As is apparent to the skilled reader, a decreased distance between the lower deck structure 330 and the main deck 340 makes it possible to lower the centre of gravity of the platform 300. This is in contrast to platforms having a clearance distance between a lower deck structure and an upper deck structure that exceeds the height of a BOP.

Hence, arranging the derrick 350 and storing the BOP 356 on the main deck 340 and decreasing the vertical distance between the main deck 340 and the lower deck structure 330 when a lower deck structure 330 is present makes it possible to design a compact offshore drilling platform 300 having a lower centre of gravity.

In addition arranging the derrick 350 on the main deck 340 gives an improved working environment in that the crew on the drilling platform 300 does not have to perform unnecessary and potentially hazardous lifting and climbing between the main deck 340 and a drilling deck arranged above the main deck 340, since the main drilling activities on the drilling platform 300 are preformed from the main deck 340 and not on a drilling deck above the main deck 340.

However, arranging the derrick 350 and storing the BOP 356 on the main deck 340 and decreasing the vertical distance between the main deck 340 and the lower deck structure 330 in case a lower deck structure 330 is present requires an improved method for handling the BOP 356.

A first embodiment of an improved method for handling the BOP 356 will be described below with reference to FIG. 2*c*-2*f*.

Starting from FIG. 2*a* and the position of the rotary table assembly 352 and the spider 354 shown therein it can be concluded that a first step SI in the exemplifying first embodiment of the method is to detach the rotary table assembly 352 from the rotary table opening 342 in the main deck 340. This leaves the rotary table opening 342 free for lowering the BOP 356 to the sea bed as will be explained later.

According to a second step S2 and a third step S3 of the exemplifying first embodiment of the method the spider 354 is arranged on top of the rotary table assembly 352 and the package comprising the spider 354 and the rotary table assembly 352 is in turn arranged on top of the BOP 356 being positioned above the rotary table opening 342.

More particularly, according to the second step S2 of the exemplifying method the spider 354 is arranged on top of the rotary table assembly 352 and the package comprising the spider 354 and the rotary table assembly 352 is in turn lifted by the derrick hook. This can e.g. be accomplished by first lifting the spider 354 onto the rotary table assembly 352 by means of e.g. the derrick hook, a crane or a fork lift (not shown) or similar arranged on the main deck 340. It is preferred that the spider 354 is attached to the rotary table assembly 352 so as to be in a substantially operable state when the rotary table assembly 352 carrying the spider 354 is subsequently lowered and fitted into the rotary table opening 342 in the main deck 340 as will be described later. However, the spider 354 may alternatively require further actions to be in an operable state when the rotary table assembly 352 carrying the spider 354 has been fitted into the rotary table opening 342 in the main deck 340.

In the third step S3 of the exemplifying first embodiment of the method the rotary table assembly 352 and the spider 354 are arranged on top of the BOP 356, which is positioned so that the derrick hook can lower the BOP 356 through the rotary table opening 342, as will be described in the fourth step S4 below. Arranging the spider 354 and the rotary table assembly 352 on the BOP 356 can e.g. be done by transporting the rotary table assembly 352 and the spider 354 by means of a trolley 357*a* or some other suitable transportation means into a position where the derrick hook can lift the rotary table assembly 352 and the spider 354. The trolley 357*a* or similar is preferably rolled back when the rotary table assembly 352 and the spider 354 are lifted. The BOP 356 is then transported by means of a trolley 357*b* or some other suitable transportation means into a position where the derrick hook can lower the rotary table assembly 352 and the spider 354 on to the BOP 356.

It is then preferred that the rotary table assembly 352 and the spider 354 are attached to the BOP 356 by suitable attaching means so that the derrick hook may lift the assembled rotary table assembly 352, spider 354 and BOP 356 as a single package. This can e.g. be accomplished by attaching the BOP 356 to the spider 354 and/or the rotary table assembly 352 by means of bolts and/or wires etc. This can alternatively and/or additionally be accomplished by utilizing the spider 354 and a riser pipe adapter that is pre-attached to the BOP 356. The riser pipe adapter is typically provided with a first end arranged to be operatively attached to the BOP 356 and a second end arranged to be operatively attached to a riser pipe. The spider 354—when it has been lowered onto the BOP 365—can then be utilized to grip around the riser pipe adapter in the same or similar way as in the well known operational mode of the spider 354 during lowering or raising the string of riser pipes under the drilling platform 300. The assembled rotary table assembly 352, spider 354 and BOP 356 are then lifted by the derrick hook, e.g. engaging the riser pipe adapter in the same or similar way as when riser pipes are connected or disconnected during lowering or raising the string of riser pipes as is well known to those skilled in the art. The trolley 357*b* or similar transportation means is then rolled back or otherwise removed. The BOP 356 is now in position that enables the derrick hook to lower the BOP 356 through the rotary table opening 342.

The result achieved by the second step S2 and the third step S3 as discussed above is schematically illustrated in FIG. 2*c*.

Before we proceed is should be added that alternative assembly solutions are conceivable. For example, the rotary table assembly 352, the spider 354 and the BOP 356 may be assembled before the BOP 356 is transported into a position that enables the derrick hook to lower the BOP 356 through the rotary table opening 342.

In a fourth step S4 of the exemplifying first embodiment of the method the assembled spider 354, rotary table assembly 352 and BOP 356 are lowered by the derrick hook towards the rotary table opening 342. More particularly, the assembled spider 354, rotary table assembly 352 and BOP 356 are lowered so that the rotary table assembly 352 is arranged in an operative position in the rotary table opening 342 of the main deck 340 and so that the BOP 356 hanging below the rotary table assembly 352 is passed through the rotary table opening 342 in the main deck 340 and preferably at least partly through the corresponding opening 332 (moon pool opening) in the lower deck structure 330 in case a lower deck structure 330 is present. The rotary table assembly 352 being arranged in an operative position in the rotary table opening 342 as stated above is mainly directed to the position as such. It does not preclude that additional measures may have to be taken before the rotary table assembly 352 becomes fully operational, e.g. such as connecting and providing hydraulic and electric capacity and attaching various pipes for communicating fluids etc. with the rotary table assembly 352.

Figure 2E:
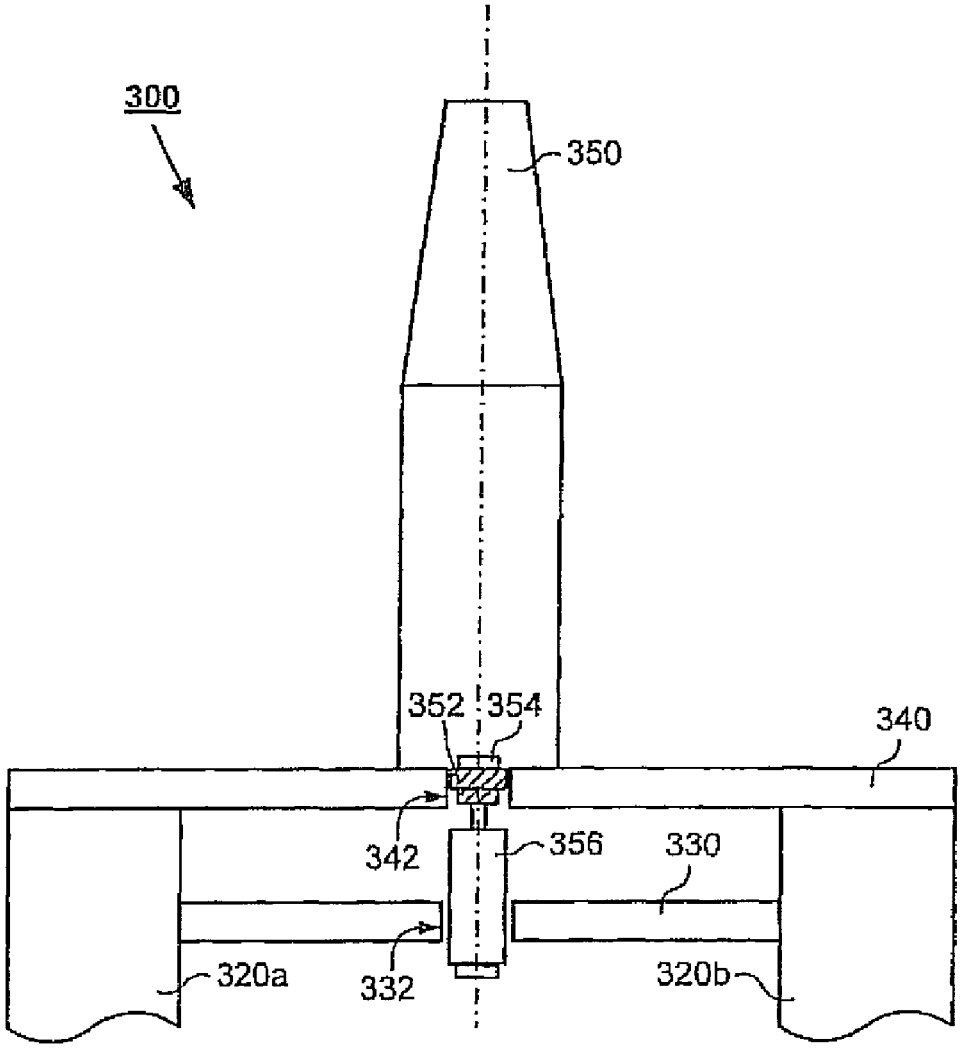
FIG. 2*e* shows a schematic illustration of a later phase in the lowering of the assembled spider 354, rotary table assembly 352 and BOP 356.
Figure 2F:
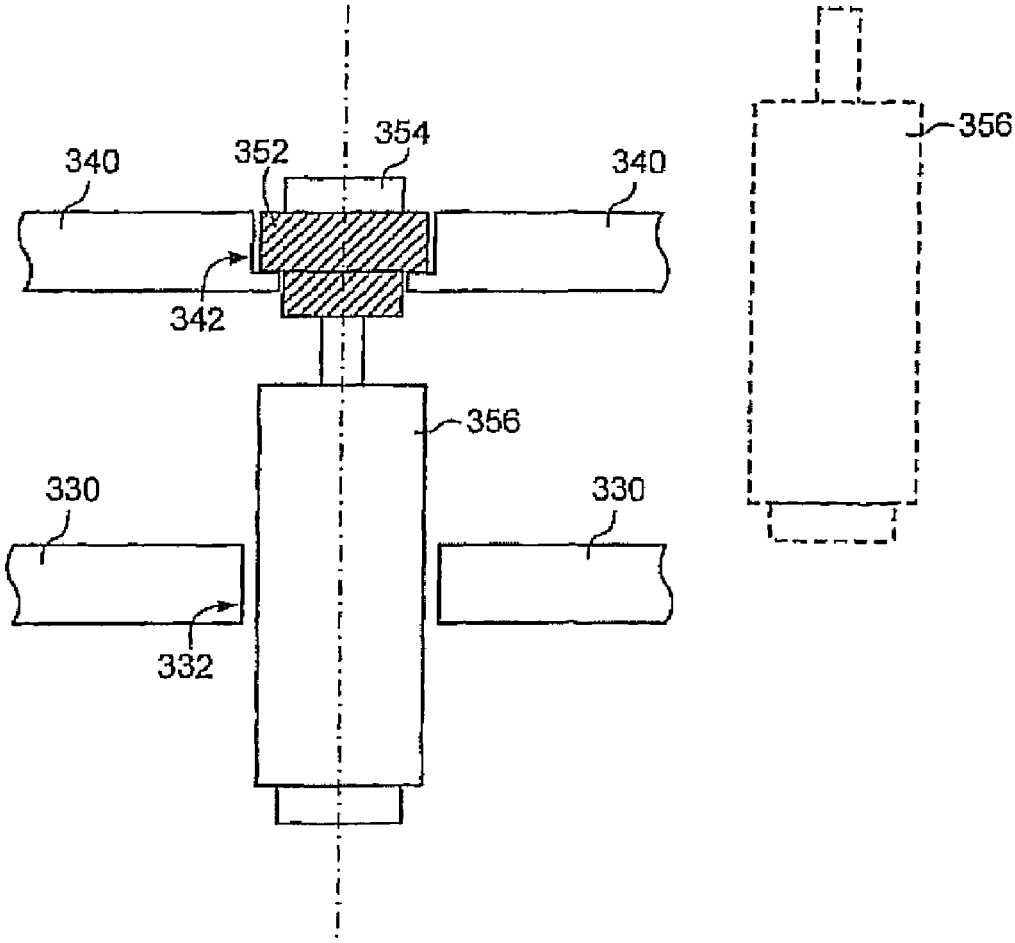
FIG. 2*f* shows a close-up of the lowering of the assembled spider 354, rotary table assembly 352 and BOP 356 in FIG. 2*e*.

A lowering of the assembled spider 354, rotary table assembly 352 and BOP 356 is schematically illustrated in FIG. 2*e*-2*f*. As is more clearly seen in the close-up of FIG. 2*f* it is preferred that the rotary table assembly 352 is substantially in flush with the upper working surface of the main deck 340, whereas the spider 354 arranged on the rotary table assembly 352 extends above the working surface of the main deck 340.

The rotary table assembly 352 and the spider 354 are now in a position for lowering the BOP 356 to the sea bed. This is preferably done by using the spider 354 for connecting further riser pipes to the BOP 356 in a manner well known to those skilled in the art. It should be added that the further riser pipes may be connected more or less directly to a suitable connector comprised by the BOP 356 itself or indirectly to a riser pipe adapter connected to the BOP 356 as previously discussed or to any other suitable connector or adapter including those well known in the art.

In a fifth step S5 of the exemplifying first embodiment of the method it is preferred that the spider 354 is removed from the rotary table assembly 352. This is typically done when the BOP 356 has reached the sea bed and there is no need to connect further riser pipes.

Figure 2G:
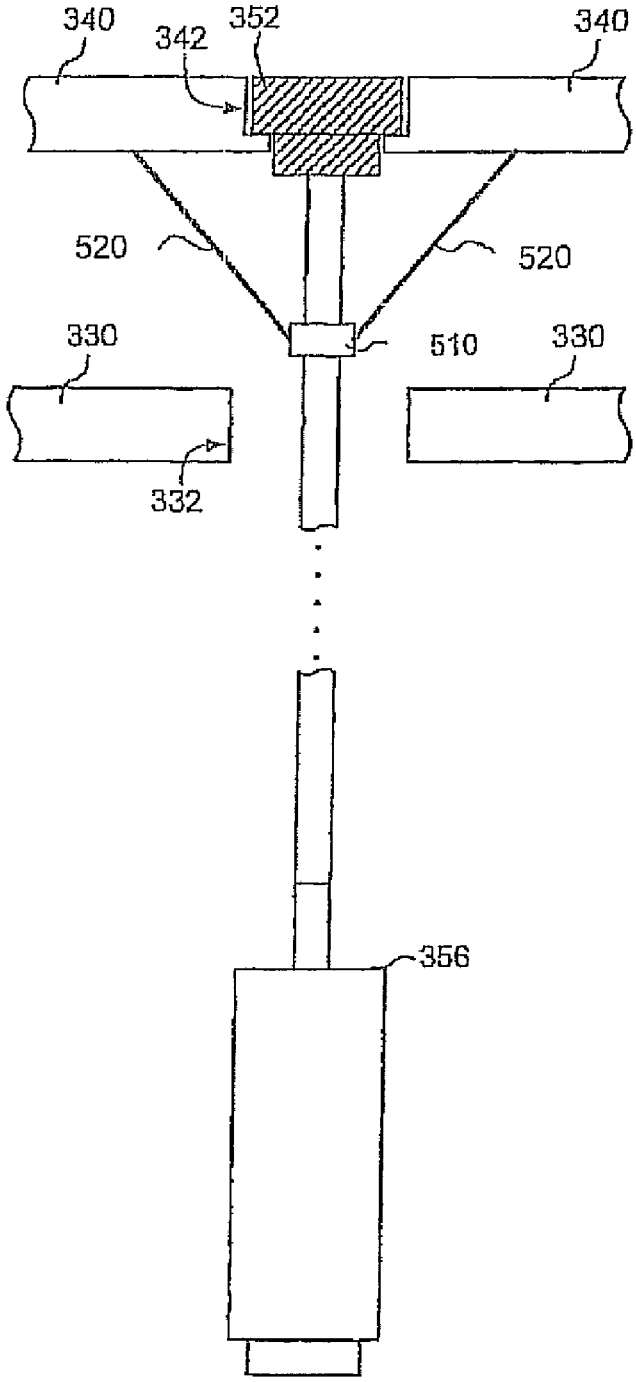
FIG. 2*g* is a schematic illustration of a riser tensioner arrangement.

Since the spider 354 supports the string of riser pipes it is preferred that this support is shifted to another arrangement before the spider 354 is removed, e.g. to a so-called riser tensioner arrangement. A riser tensioner arrangement is schematically illustrated in FIG. 2*g* comprising a tensioning ring 510 or similar attached beneath the main deck 340 by means of hydraulically suspended wires 520 or similar. Different aspects of riser tensioners are e.g. discussed in WO 93/19279 published 30 Sep. 1993, U.S. Pat. No. 5,148,871 published 22 Sept. 1992 and U.S. Pat. No. 4,501,219 published 26 Feb. 1985. Once the string of riser pipes is supported by the riser tensioner arrangement it is safe to remove the spider 354. This can be clone by e.g. lifting the spider 354 by means of the derrick hook and lowering it onto a trolley 357*a* for transportation away from the derrick 350.

The steps of a second embodiment of the method according to the present invention are explained below with reference to FIG. 3*a*-3*d* and suitable parts in FIG. 2*a*, FIG. 2*c*-2*g*.

A first step S1' of the exemplifying second embodiment of the method is to detach the rotary table assembly 352 from the rotary table opening 342 in the main deck 340 so as to leave the opening 342 free for lowering the BOP 356 to the sea bed.

In a second step S2' of the exemplifying second embodiment of the method only the spider 354 is arranged on top of the BOP 356, which is positioned so that the derrick hook can lower the BOP 356 through the rotary table opening 342 as will be described in the fourth step S4' below. Arranging the spider 354 on top of the BOP 356 can e.g. be done, by transporting the spider 354 by means of a trolley 357*a* or some other suitable transportation means into a position where the derrick hook can lift the spider 354. The trolley 357*a* or similar is preferably rolled back when the spider 354 is lifted. The BOP 356 is then transported by means of a trolley 357*b* or some other suitable transportation means into a position where the derrick hook can lower the spider 354 on to the BOP 356 and then subsequently lower the BOP 356 through the rotary table opening 342.

It is preferred that the spider 354 is attached to the BOP 356 by suitable attaching means so as to enable the derrick hook to lift the assembled spider 354 and BOP 356 as a single package. This can e.g. be accomplished by attaching the BOP 356 to the spider 354 as describe above in connection with the method according to the first embodiment of the present invention.

The result achieved by the second step S2' as discussed above is schematically illustrated in FIG. 3*a*.

Before we proceed it should be added that alternative assembly solutions are conceivable. For example, the spider 354 and the BOP 356 may be assembled before the BOP 356 is transported into a position that enables the derrick hook to lower the BOP 356 through the rotary table opening 342.

In a third step S3' of the exemplifying second embodiment of the method the assembled spider 354 and BOP 356 are lowered by the derrick hook into the rotary table opening 342. More particularly, the assembled spider 354 and BOP 356 are lowered so that the spider 354 is arranged in an operative position in the rotary table opening 342 of the main deck 340 and so that the BOP 356 hanging below the spider 354 is passed through the rotary table opening 342 in the main deck 340 and preferably at least partly through the corresponding opening 332 (moon pool opening) in the lower deck structure 330 in case a lower deck structure 330 is present. The spider 354 being arranged in an operative position in the rotary table opening 342 as stated above is mainly directed to the position as such and does not preclude that some additional measures may have to be taken before the spider 354 becomes operational.

Figure 3C:
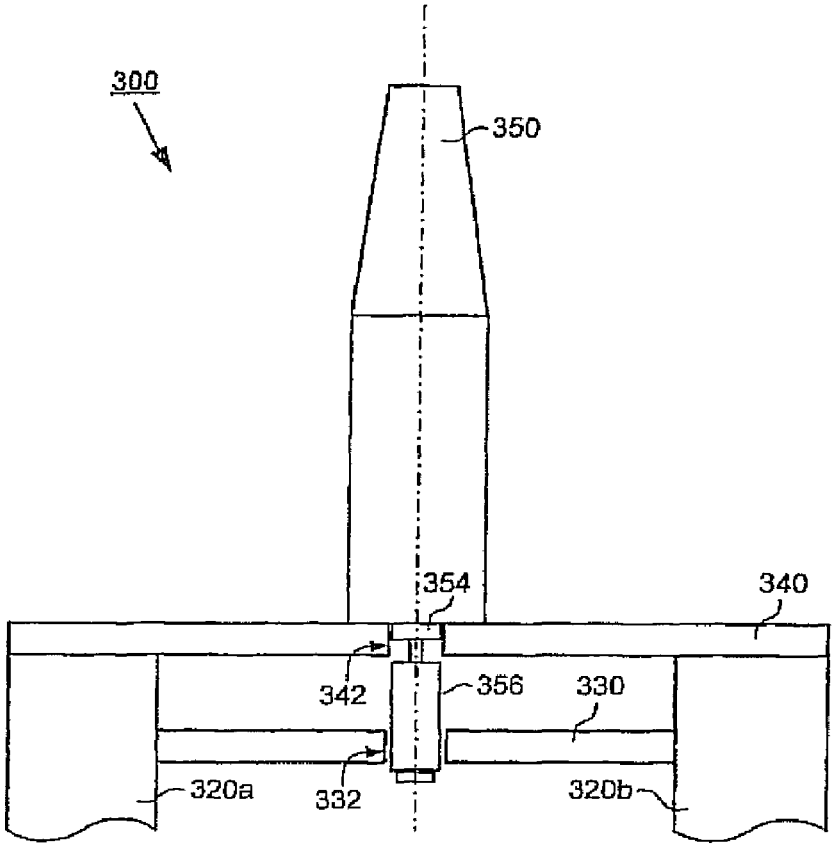
FIG. 3*c* shows a schematic illustration of a later phase in the lowering of the assembled spider 354 and BOP 356.
Figure 3D:
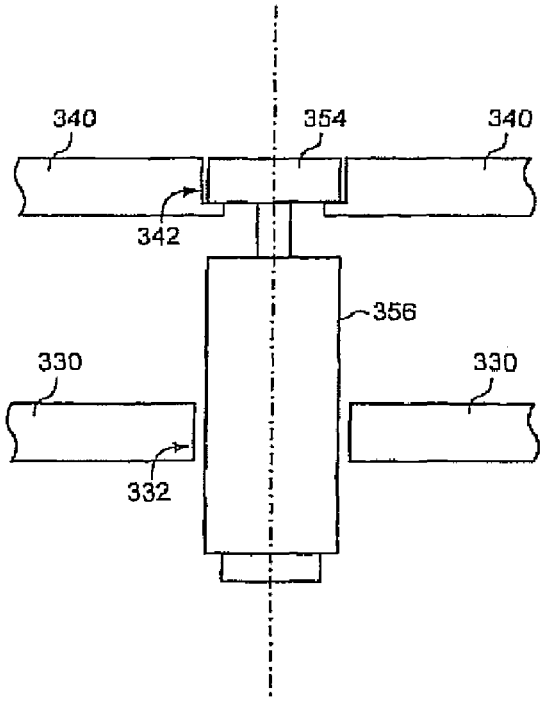
FIG. 3*d* shows a close-up of the lowering of the assembled spider 354 and BOP 356 in FIG. 3*c*.

A lowering of the assembled spider 354 and BOP 356 is schematically illustrated in FIG. 3*b*-3*d*. As is more clearly seen in the close-up of FIG. 3*d* it is preferred that the spider 354 is substantially in flush with the upper working surface of the main deck 340. However, as the skilled reader recognizes this may require that the rotary table assembly 352 and the spider 354 have substantially the same size so as to fit into the same rotary table opening 342 of the main deck 340, at least in the horizontal direction. The size of the rotary table assembly 352 and/or the spider 354 may be modified if necessary e.g. by means of adapters.

The spider 354 is now in a position for lowering the BOP 356 to the sea bed. This is preferably done by means of using the spider 354 for connecting further riser pipes to the BOP 356 as is well known to those skilled in the art. It should be added that the further riser pipes may be connected directly to a suitable connector comprised by the BOP 356 itself, or indirectly to a riser pipe adapter connected to the BOP 356 as previously discussed or to any other suitable connector or adapter including those well known in the art.

In a fourth step S4' of the exemplifying second embodiment of the method it is preferred that the spider 354 is removed from the rotary table opening 342 and replace by the rotary table assembly 352. Since the spider 354 supports the string of riser pipes it is preferred that this support is shifted to a riser tensioner arrangement before the spider 354 is remove, as described above with reference to FIG. 2*g*. Once the string of riser pipes is supported by the riser tensioner arrangement it is safe to remove the spider 354, which e.g. can be done by lifting the spider 354 by means of the derrick hook and lower it onto a trolley 357*a* for transportation away from the derrick 350. The rotary table assembly 352 may then be transported by means of e.g. a trolley 357*b* into a position where it can be lifted by the derrick hook. The rotary table assembly 352 is preferably lifted and then lowered into an operable position in the rotary table opening 342 once the trolley 375*b* has been moved away from the derrick 350.

The two exemplifying embodiments of a method for handling the BOP 356 as described above enable the derrick 350 and the BOP 356 to be arranged and stored respectively on the main deck 340 of the drilling platform 300. It also enables a reduction of the vertical distance between the main deck 340 and a lower deck structure 330 in case a lower deck structure 330 is present. Each of these measures makes it possible to design a more compact drilling platform 300 having a lower centre of gravity.

It should be emphasised that the steps preformed by two exemplifying embodiment as described above must not necessarily be performed in the order in which they are listed or described.

In addition, when a lower deck structure 330 is present it is preferred to arrange process tanks and mud pits on the lower deck 330 for handling return drilling mud and cuttings from the drilling. However, to keep a low centre of gravity for the drilling platform 300 it is preferred that process tanks and the mud pits are arranged at the same level or height. Arranging the process tanks and the mud pits at the same lever makes it very difficult to use a traditional overflow from the process tanks to the mud pits, since this requires that the process tanks are positioned at a higher level than the mud pits. This would typically require an increased vertical clearance between the lower deck 330 and the main deck 340 contrary to the wish for a low centre of gravity for the drilling platform 300.

Figure 4A:
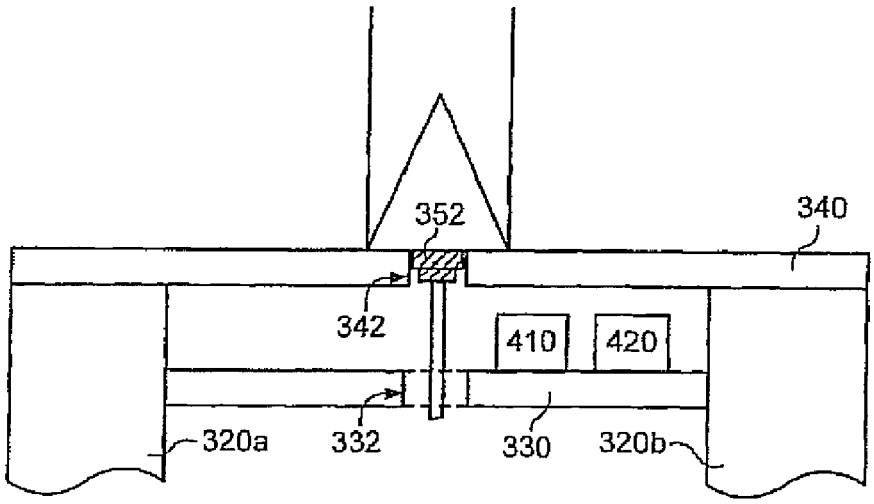
FIG. 4*a* is a schematic illustration of a lower deck structure 330 provided with process tanks 410 and mud pits 420.
Figure 4B:
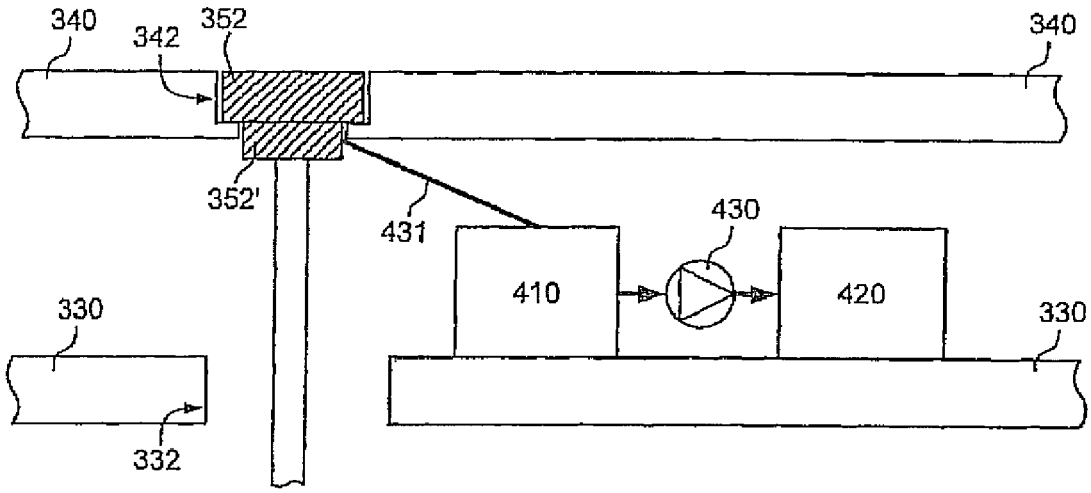
FIG. 4*b* is a schematic close-up of the lower deck structure 330 provided with process tanks 410 and mud pits 420 in FIG. 4*a*.

FIGS. 4*a*-4*b* illustrates a solution to this problem according to which the process tanks 410 and the mud pits 420 are arranged on the same level. The process tanks 410 receive drilling mud and drill cuttings via a pipe 431 from the diverter 352'. The diverter 352' is arranged below the rotary table 352 and connected to the last pipe in the string of riser pipes for receiving drilling mud and cuttings from the drilling. This is well known by those skilled in the art. The drill cuttings are separated from the drilling mud and the mud is cleaned in the process tanks 410, which is also well known to those skilled in the art. The cleaned drilling mud is then transferred to the mud pits 420 by means of a pump arrangement 430, which obviated the need for an overflow from the process tanks 410 into the mud pits 420.

It is to be understood that the present invention is not limited to the embodiments described above and illustrated in the drawings; rather, the skilled person will recognize that many changes and modifications may be made within the scope of the appended claims.

The invention claimed is:

1. A drilling platform adapted to float in a body of water, said body of water comprising a sea bed, the drilling platform comprises:

a lower pontoon structure;

a plurality of columns extending upwards from the lower pontoon structure;

an upper deck structure connecting the upper portions of the columns to each other;

a derrick, a detachable rotary table assembly, a spider, and a blow-out-preventer, said blow-out preventer being adapted to be lowered to said sea bed;

wherein:

the upper deck structure is provided with a rotary table opening, which is adapted to receive the detachable rotary table assembly and to allow the blow-out-preventer to pass through;

the derrick is arranged on the upper deck structure above the rotary table opening;

a lower deck structure is arranged below the upper deck structure at a vertical distance that is less than the height of the blow-out-preventer.

2. A drilling platform according to claim 1, wherein:

the upper deck structure is provided with a storage space for the blow-out-preventer.

3. A drilling platform according to claim 1, wherein: the upper deck structure is provided with transportation means for transporting the blow-out-preventer on the upper deck structure.

4. A drilling platform according to claim 1, wherein process tanks and mud pits are arranged on the lower deck structure and being interconnected by means of a pump arrangement for pumping drilling mud from the process tanks to the mud pits.

5. A method for handling a blow-out-preventer on a drilling platform adapted to float in a body of water, said body of water comprising a sea bed, the drilling platform having a lower pontoon structure; a plurality of columns extending upwards from the lower pontoon structure; an upper deck structure connecting the upper portions of the columns to each other; a detachable rotary table assembly arranged in a rotary table opening in the upper deck structure; a derrick provided with a lifting arrangement and being arranged on the upper deck structure above the rotary table opening; a spider; and a lower deck structure arranged below the upper deck structure at a vertical distance that is less than the height of the blow-out-preventer;

wherein the steps of:

detaching the rotary table assembly from the rotary table opening;

arranging at least the spider on the blow-out-preventer;

positioning the blow-out-preventer so that the lifting arrangement of the derrick can lower the blow-out-preventer through the rotary table opening;

lowering the spider and the blow-out-preventer into the rotary table opening by means of said lifting arrangement so that the blow-out-preventer is passed through the rotary table opening and so that the spider is arranged in the rotary table opening in an operative position for supporting riser pipes, said blow-out-preventer being adapted to be lowered to said sea bed.

6. The method according to claim 5, wherein the extended steps of:

arranging both the rotary table assembly and the spider on the blow-out-preventer;

lowering both the rotary table assembly and the spider as well as the blow-out-preventer into the rotary table opening by means of the lifting arrangement of the derrick, so that the blowout preventer is passed through the rotary table opening, and so that the rotary table assembly is arranged in the rotary table opening in an operative position for supporting the drilling pipes, and so that the spider is arranged in an operative position for supporting riser pipes.

7. The method according to claim 5, wherein the spider is replaced by the rotary table assembly by the steps of:

supporting the riser pipes by a riser pipe tensioner arrangement;

removing and transporting the spider from the rotary table opening by the lifting arrangement of the derrick and transportation means on the upper deck structure;

transporting and lowering the rotary table assembly to an operative position in the rotary table opening by transportation means and the lifting arrangement of the derrick.

8. The method according to claim 6, wherein the spider is removed by the steps of:

supporting the riser pipes by a riser pipe tensioner arrangement;

removing and transporting the spider from the rotary table opening by the lifting arrangement of the derrick and transportation means on the upper deck structure.

* * * * *